United States Patent [19]

Schmalholtz

[11] Patent Number: 4,790,896

[45] Date of Patent: Dec. 13, 1988

[54] MANUAL CONTROL DEVICE FOR TAPING ARTICLES SUCH AS NOTABLY BUNCHES OF CABLES

[75] Inventor: Denis Schmalholtz, Cormeilles en Parisis, France

[73] Assignee: Derfi, Cormeilles en Parisis, France

[21] Appl. No.: 119,447

[22] Filed: Nov. 12, 1987

[30] Foreign Application Priority Data

Nov. 17, 1986 [FR] France ..... 86 15936

[51] Int. Cl.[4] ..... B65H 81/08

[52] U.S. Cl. ..... 156/392; 57/10; 100/13; 100/27; 156/428; 156/468; 242/7.08; 242/7.23

[58] Field of Search ..... 156/468, 475, 187, 195, 156/425, 392, 428, 429, 430, 431; 242/4 B, 6, 7.08, 7.23

[56] References Cited

U.S. PATENT DOCUMENTS

| | | | |
|---|---|---|---|
| 1,998,910 | 4/1935 | Rosener | 156/392 |
| 3,374,615 | 3/1968 | Evanicsko | 57/10 |
| 4,106,709 | 8/1978 | Ortmans et al. | 242/7.08 X |
| 4,346,550 | 8/1982 | Ferree | 242/7.08 X |
| 4,488,685 | 12/1984 | Iida | 242/7.23 X |
| 4,732,643 | 3/1988 | Chikatani | 156/468 X |

*Primary Examiner*—David Simmons

*Attorney, Agent, or Firm*—Pollock, VandeSande & Priddy

[57] ABSTRACT

A portable manual control device for taping articles such as for example bunches of electrical cables with a flexible material in the shape of a tape, a band or a cord, unwound from a coil carried by the device, said device including a platen supporting a driving motor as well as control means for said motor, and formed with an opened passage for receiving the article, a rotary crown rotating on the platen being controlled in rotation by the motor via a driving means, the crown being formed with an opening in which is engaged the article to be taped when said opening is in register with the opened passage of the platen, and at least one feed coil with the flexible material in the shape of a tape, band or cord, with return and guiding means for said material, characterized in that the rotary crown includes in the bottom of its opening receiving the article a curved guide for positioning the article in the crown, a slot being provided in the guide for bringing the flexible material in contact with the article, said guide including moreover adjacent the slot at least two rollers for avoiding friction of the material while allowing its helical winding on the article, following the rotation of the crown and the manual displacement of the platen according to the length of said article, while controlling the pitch and the winding direction on said article, the platen being provided with a single handle held by the hand of a user while the article is guided by other hand of said user.

20 Claims, 5 Drawing Sheets

MANUAL CONTROL DEVICE FOR TAPING ARTICLES SUCH AS NOTABLY BUNCHES OF CABLES

FIELD OF THE INVENTION

The object of the present invention is a portable manual control device designed for taping any elements, generally of curved or elongated shape, such as notably bunches of any nature, and more particularly bunches of electrical cables, bars, tubes or similar, for any industrial field and notably the automobile industry.

For some applications, it is known to make the taping of articles and notably of cable bunches entirely by hand. Of course, this solution is costly due to the labor involved, its application being the cause of a prejudicial waste of time.

At the present time however, one uses preferably for the taping of such articles machines comprising mobile heads mechanically displaceable. Said machines are generally bulky and they need to be displaced in front of the mobile article to be taped through the machine, which is in turn moved with respect to the article maintained by supports generally complicated. Moreover, if the article is fixed and the machine mobile, said supports have to be retracted during the passage of the machine.

A portable taping machine, which includes a platen supporting a driving motor as well as control means of said motor and being formed with a passage opened for receiving the article to be taped, a rotary crown rotating on the platen with its rotation controlled by the motor via a driving means, the crown being formed with an opening in which is engaged the article to be taped when said opening is in register with the opened passage of the platen and when at least one feed coil of a flexible material in the shape of a tape, a band or a cord for taping the article, with return and guiding means for said material, are also known by U.S. Pat. No. 4,346,550.

But this known device still has disadvantages. In particular, the design of the machine is such that it has to be held by the user with his two hands, the platen being provided to this effect with two handles, this demanding that the article to be taped be in turn guided by complementary means the presence of which makes the use of the machine difficult, mainly if said article is of a complex shape. Notably, the device according to this prior art U.S. patent can, in practice, only put one tape on a cable or similar, rectilinear or substantially rectilinear, along which the platen is then moved by the user. On the other hand, with the machine known from this prior art patent, the setting in position of the tape on the article to be taped can only be done according to one orientation which remains constant, with a predetermined angle to the article axis. Likewise, said machine is designed for providing the application of the tape with a constant tension which has to remain equal to itself as the diameter of the coil supplying the tape is decreasing. From this point of view, the machine needs control means for the tension, which make it complicated.

The object of the present invention is a mobile and portable manual control apparatus, but automatically taping, which allows simplifying the process of setting the tape in position about the article to be taped and reduces the cost of such a machine when compared to the various systems presently used for taping bunches of cables or similar. Particularly, the machine can be used for taping cables made on a board or a support of the same type with a permanent electric control incorporated to said cable, whereby the taping can be effected at the level of the board itself, without it being necessary to disconnect the electric power fed to the bunch.

The machine according to the invention has also as advantage to be able to follow easily the profile of the article or object to be taped, whatever the object, particularly if it is formed with bent portions or other changes of direction, whereby the user can hold the machine with a single hand and the object with the other, by adopting moreover as often as needed changes of winding direction without being compelled to maintain the tension of the tape which is necessarily constant during the taping operation.

The machine according to the invention can be of light weight, easy to handle, while providing a permanent support for the article via a guide conveniently arranged and provided in the rotary crown, said guide including means adapted for bringing the tape on the article to be taped under the best conditions independently of the winding direction which is followed.

Consequently, the invention has as an object a mobile and portable manual control device for taping an article such as notably a bunch of electrical cables with a flexible material in the shape of a tape, a band or a cord, unwound from a coil carried by the device, said device including a platen supporting a driving motor as well as control means for said motor, and formed with an opened passage for receiving the article, a rotary crown rotating on the platen by being controlled in rotation by the motor via a driving means, the crown being formed with an opening in which is engaged the article to be taped when said opening is in register with the opened passage of the platen, and at least one feed coil with the flexible material, with return and guiding means for said material, characterized in that the rotary crown includes in the bottom of its opening receiving the article a curved guide for positioning the article in the crown, a slot being provided in the guide for bringing the flexible material in contact with the article, said guide including moreover adjacent the slot at least two rollers for avoiding friction of the material while allowing its helical winding on the article, following the rotation of the crown and the manual displacement of the platen according to the length of said article, while controlling the pitch and the winding direction on said article, the platen being provided with a single handle held by the hand of a user while the article is guided by the other hand of said user.

According to another feature of the present invention, there are provided protection means carried by the platen at the inlet of the passage receiving the article to be taped, said protection means being provided preferably in the form of flaps, latched in a closed position when the rotary crown driving motor is operated, and of a circular shaped protective cowling, preferably transparent.

According to another feature of the invention, the single gripping handle provided on the platen includes a double control trigger system for the motor, a first trigger for the normal control of the rotation of said motor in view of the taping operation and a second trigger for a progressive control of the rotation, for starting a positive repositioning cycle of the rotary crown in order to bring the apparatus in an opened position, that is in a position which brings the respective passages of the platen and of the rotary crown in register so as to facilitate the introduction and extraction of the articles to be taped and of the articles which have been taped. The two triggers are interlocked to each other.

According to still another feature of the invention, the system providing for the driving of the mobile crown by the motor is made of an endless belt fitted out with a double rocking lever type tensioning system with an action proportional to the resisting torque in order to obtain a tensioning of the belt reduced to the minimum.

In another alternative embodiment, the handle includes two triggers, of which one acts via abutments of different lengths on the contacts of a micro-relay, causing according to the case the operation of the motor at constant but different speeds.

As a variant, the platen supports a fixed half cowling and a mobile half cowling, both articulated on the platen, the two half cowlings being returned to a bearing position one against the other in order to close the passage of the platen under the effect of a spring attaches at its ends on one and the other of said half cowlings.

BRIEF DESCRIPTION OF THE DRAWINGS

Other features and advantages of the present invention will become more apparent from the hereafter description, made with reference to the accompanying drawings illustrating various embodiments thereof without any limiting character.

In the drawings.

DETAILED DESCRIPTION OF THE INVENTION

Figure 1:
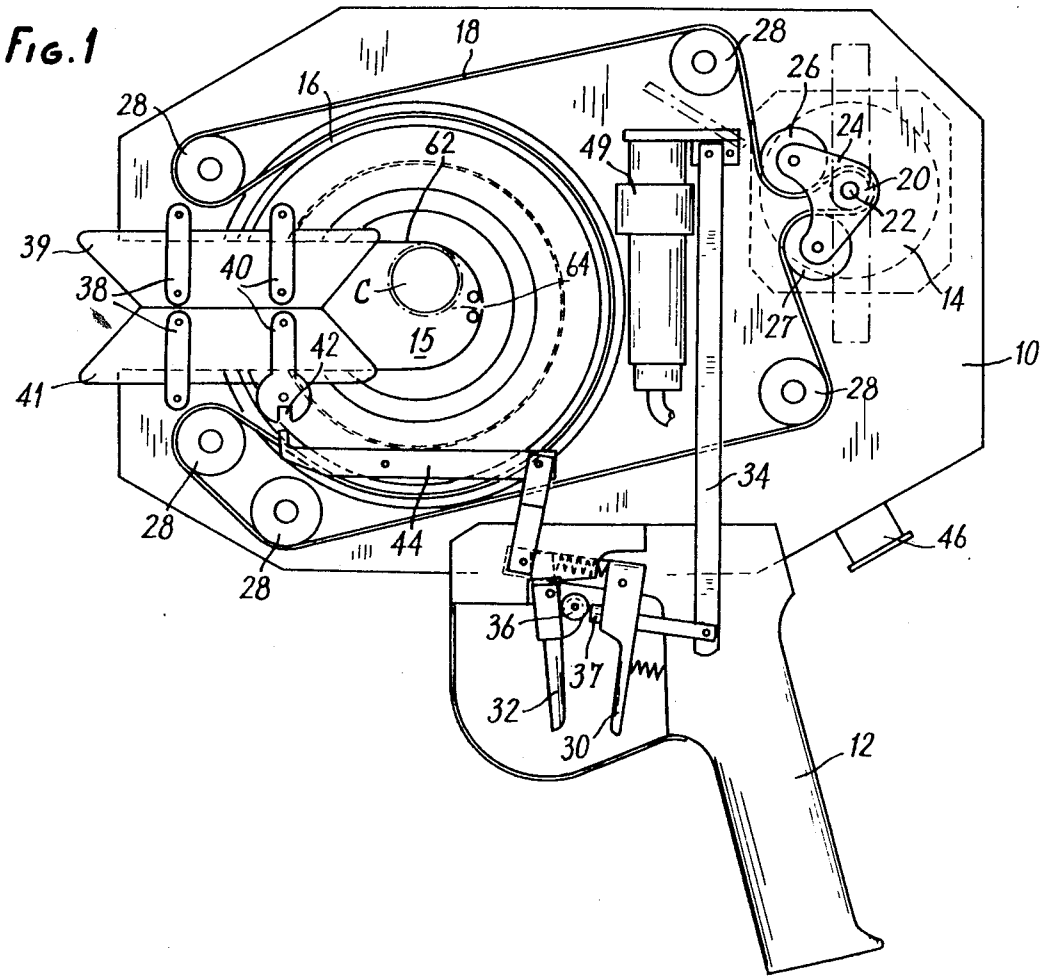
FIG. 1 is an elevational view showing the device according to the invention, with the tape feeding system removed.
Figures 2, 3:
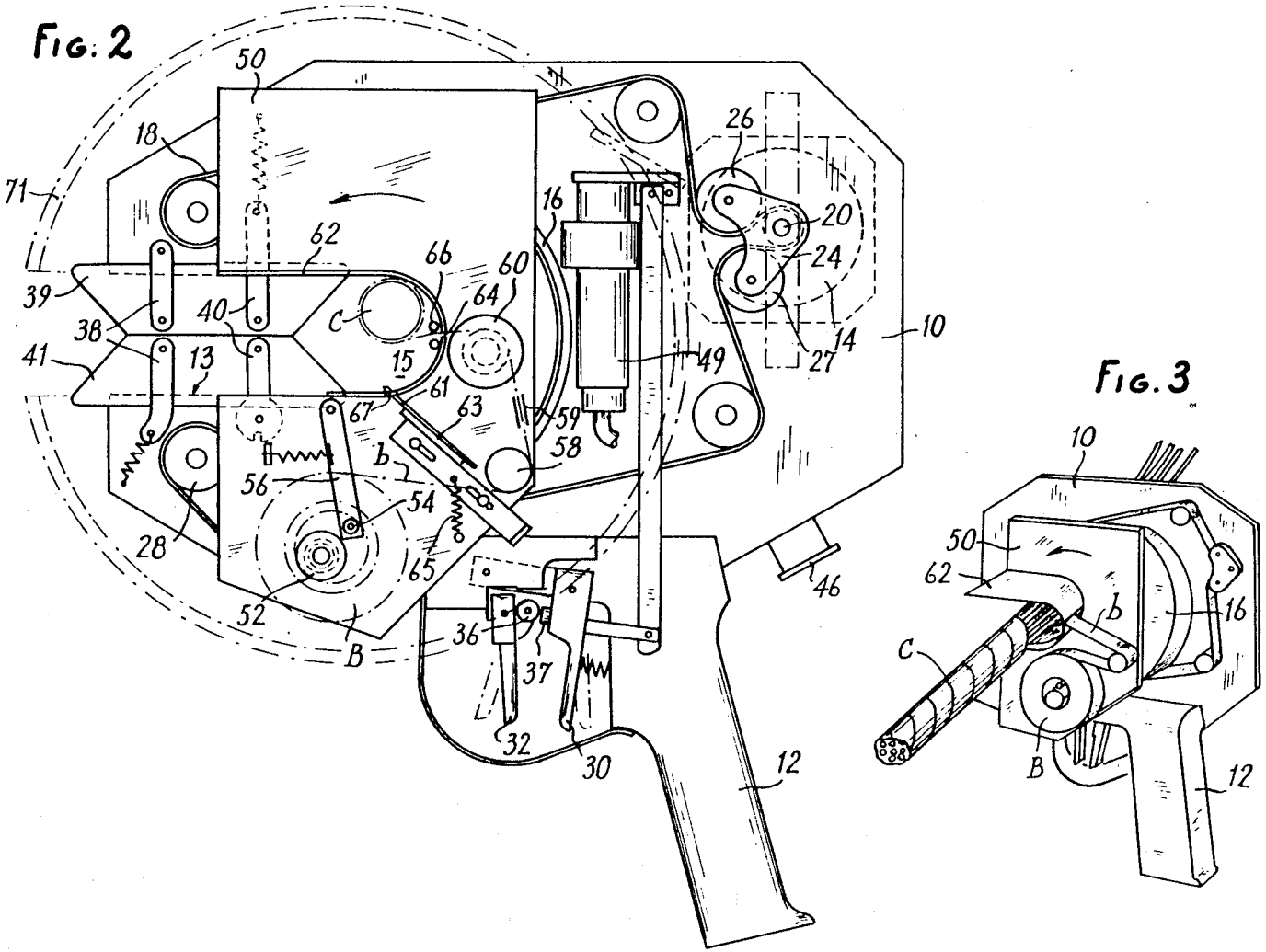
FIG. 2 is also an elevational view of the complete device according to the invention.
FIG. 3 is a simplified view showing in perspective the device according to FIGS. 1 and 2.

Reference is first made to the drawings and more particularly to FIGS. 1 and 2 which illustrate a first embodiment of the device object of the invention. Said device includes substantially a platen 10 provided with a single handle 12 allowing the user to manually operate the device on or facing the article to be taped in a manner which will be made clear later. On said platen 10 is mounted a driving motor 14, which can be pneumatic, electric low voltage or other. In this example, motor 14 is an electric motor driving a roller 20 with an axis 22 and is controlled via a double trigger 30–32 system operating a stem 34 with which the position of a magnetic element, not shown, can be varied inside a coil 49 by modifying the field created by the latter and therefore the speed of motor 14 associated therewith. Trigger 30 returned by a spring provides for the normal operation of the motor while trigger 32 is designed so as to control the starting of a relative repositioning cycle of a rotary crown carried by the platen, with respect to the latter, in the manner hereafter described.

As can be seen in FIG. 1, trigger 32 supports a roller 36 bearing on a push-piece 37 mounted on the frontal face of trigger 30, and this in order to operate the mechanism which varies the field in coil 49, thereby allowing a modification of the speed of motor 14. Platen 10 includes on the other hand a passage 13 opened at one end for allowing the introduction and positioning of the article to be taped in the device, said article being here a bunch of cables C.

On said platen 10 is mounted a rotary crown 16 via appropriate bearings (not shown). Said crown is driven by motor 14 via an endless belt 18, forming a loop. Said belt 18 is guided by means of a plurality of rollers 28 freely rotating about axes supported by the platen and its tensioning is set via a rocking lever 24 with two rollers 26, 27, mounted on axis 22 of driving roller 20. Due to this belt tensioning device, the action of which is proportional to the resisting torque, it is notably possible to obtain a tensioning of a belt particularly reduced without being prejudicial to the driving efficiency it produces for the rotary crown, thereby allowing minimizing the operating noises as well as the wear of the belt. Moreover, due to its flexibility, said device allows accommodating the difference of path of travel of belt 18, which is due to the presence of a slot-shaped opening 15 also formed in the circular crown 16 for the introduction of article C. Said opening 15 corresponds to passage 13 provided in the platen 10. It is provided in its bottom with a curved guide 62, rigidly connected to the crown. Moreover and according to the invention, in order to have an accurate and fixed positioning of article C under all circumstances when the apparatus is operating, said guide 62 includes preferably a branch of greater length than the other, as can be seen in FIG. 2.

On the rotary crown 16 is mounted a support 50 for feeding a tape, cord or similar of a flexible material used for taping article C. Said tape b is conditioned in the shape of a coil B maintained on support 50 driven in rotation with crown 16 by an assembly including on the one hand a shouldered roller 52 and on the other hand a shaft 54 mounted at the end of an oscillating arm 56. The distance between the axes of roller 52 and shaft 54 is thus variable, so as to allow the mounting of coils b of various diameters, whereby the shouldered roller 52 can moreover accommodate coils having also different widths. Tape b paid out from coil B passes successively on a cylindrical roller 58, then on another roller 60 having advantageously a concave profile so as to allow, according to the relative orientation of the device with respect to article C, a change of orientation of the winding direction of tape b on said article, according to the wishes of the user, notably as said user, while holding in a hand the device by handle 12 and article C with his other hand, is orienting one with respect to the other by following the article and the contour of said article. Advantageously, the machine includes on the path of travel of tape b, between rollers 58 and 60, a mechanical brake 59, regulating the unwinding of the tape. Said tape, at the outlet of concave-shaped roller 60, is brought in contact with article C after having passed through a narrow slot 64 formed in guide 62, said slot 64 being associated in its immediate vicinity with two rollers 66 the object of which is to avoid any friction between tape b and the surfaces in register of the slot, this allowing eliminating any risk of deterioration of the tape through the edges of the slot.

The device includes on the other hand a tape cutting system, formed of a blade 61 mounted on a slide 63 returned by a spring 65, the blade extending through a slot 67 of guide 62 in order to cut the tape when the taping of article C is completed and the crown is stopped.

Also, the device includes a protection means for the user, notably during the taping of article C. In the embodiment considered in FIGS. 1 and 2, said means is made of two double flaps, respectively 39 and 41, articulated on platen 10 via small connecting rods 38 and 40 forming with the flaps two deformable parallelograms. Said flaps 39 and 41 are placed across the passage 13 and the opening 15 respectively of the platen and the crown 16, so that, when in a spread apart position following the pivoting of the small connecting rods 38 and 40, they free the passage for article C when the slot and the opening are mutually in coincidence. After introduction of the article, the flaps are brought to a position which is close to each other where they enclose the article, the flaps being in this position latched one against the other. To this effect the device includes a stem 44 actuated by a return device controlled by the double trigger system 30–32 controlling the rotation of motor 14, the end of stem 44 engaging into a slot 42 formed in one of the small articulations connecting rods 40 of said flaps for ensuring the latching of flaps 39 and 41.

In FIG. 2 also is schematically shown a transparent protecting cowling 71 adapted for being put in position around the device once said device is ready to operate, article C being in that case introduced and enclosed inside curved guide 62.

In the embodiment shown, both triggers 30 and 32 are preferably interlocked to each other via a mounting system of the pin-slot type not shown in the drawing. Other accessory dispositions can also be considered, for example, and although the device is of reduced weight due to its very simple design, it can be suspended by means of a standard balancing system, connected to a mobile bracket crane in order to cover the whole of the area where it has to be implemented. An emergency stop knob 46 is mounted on platen 10, preferably in a position where it can be actuated by the top of the user's wrist with the hand holding the handle, said knob 46 controlling the immediate stoppage of motor 14.

The operation of the device of the embodiment shown in the above FIGS. 1 and 3 is the following:

The user who holds the device in one of his hands by using the gripping handle 12, actuates at first trigger 32 in order to start motor 14 for the control of a preliminary repositioning cycle, bringing passage 13 and opening 15 respectively of platen 10 and rotary crown 16 in register, and this in order to allow the introduction in the device of article C through flaps 39 and 41 conveniently spread apart. Once the article is in position, the trigger 32 is no more used, stem 44 being brought back to a position where it extends through slot 42 via its end and locks, the flaps against one another, article C remaining trapped behind said flaps against the guide 62.

Then the user operates trigger 30 thereby controlling the progressive rotation of motor 14, by a variation of the field created in coil 49. Motor 14 drives in rotation the mobile crown 16 via belt 18, said rotation of the crown being correlatively transmitted to support 50 of the feed coil B. Tape b which is paid out from said coil, conveniently guided by rollers 58 and 60 and introduced in guide 62 through slot 64 can then be wound on article C which the user holds with his other hand, thereby allowing following easily the profile of the article with the apparatus, notably by resorting each time it is necessary to a variation of the winding direction on the article, toward the right or toward the left, with an angle more or less pronounced. Said variations are made possible by simultaneously using the concave-shaped roller 60 and an assembly designed in such manner that, while holding the device in a single hand, the user can easily modify the inclination thereof with respect to the article. It should be noted that during this movement and whatever the orientation of the tape, said tape is guided when passing through the narrow slot 64 when entering the curved guide 62 by rollers 66. The device according to the invention can therefore tape an article of any shape without it being necessary to cut the tape and to start the taping operation anew, as is the case with standard machines.

Advantageously and for reducing the friction between article C in the bottom of guide 62, said guide is made of a low coefficient of friction material, for example brass, or any other material coated with a plastic film of the "Teflon" type or other; moreover, guide 62 has preferably a slightly bulging section toward the outside.

Due to its design, the apparatus can thus be made in such manner that its operation is unidirectional, but authorizing by turning the device over 180°, said movement being obtained with the assistance of a rotation ring, a change of the taping direction, the tape being in each case wound on the article according to a single helical winding, preferably of constant pitch. In this case, the platen can include two control handles, symmetrical with respect to each other but playing alternately the part of a single handle.

Amongst the advantages brought about by the device, one can note, due to the simplicity of the means it implements, a reduced weight added to a rapid interchangeability of the taping flexible material feed coil. The device is easy to use and allows a simple and quick setting in position of the tape on the article, whatever the profile of said article. Finally, the device is designed for a high safety of use, due to the protection cowling, the double trigger control system and the emergency stop knob which it includes.

Figure 4:
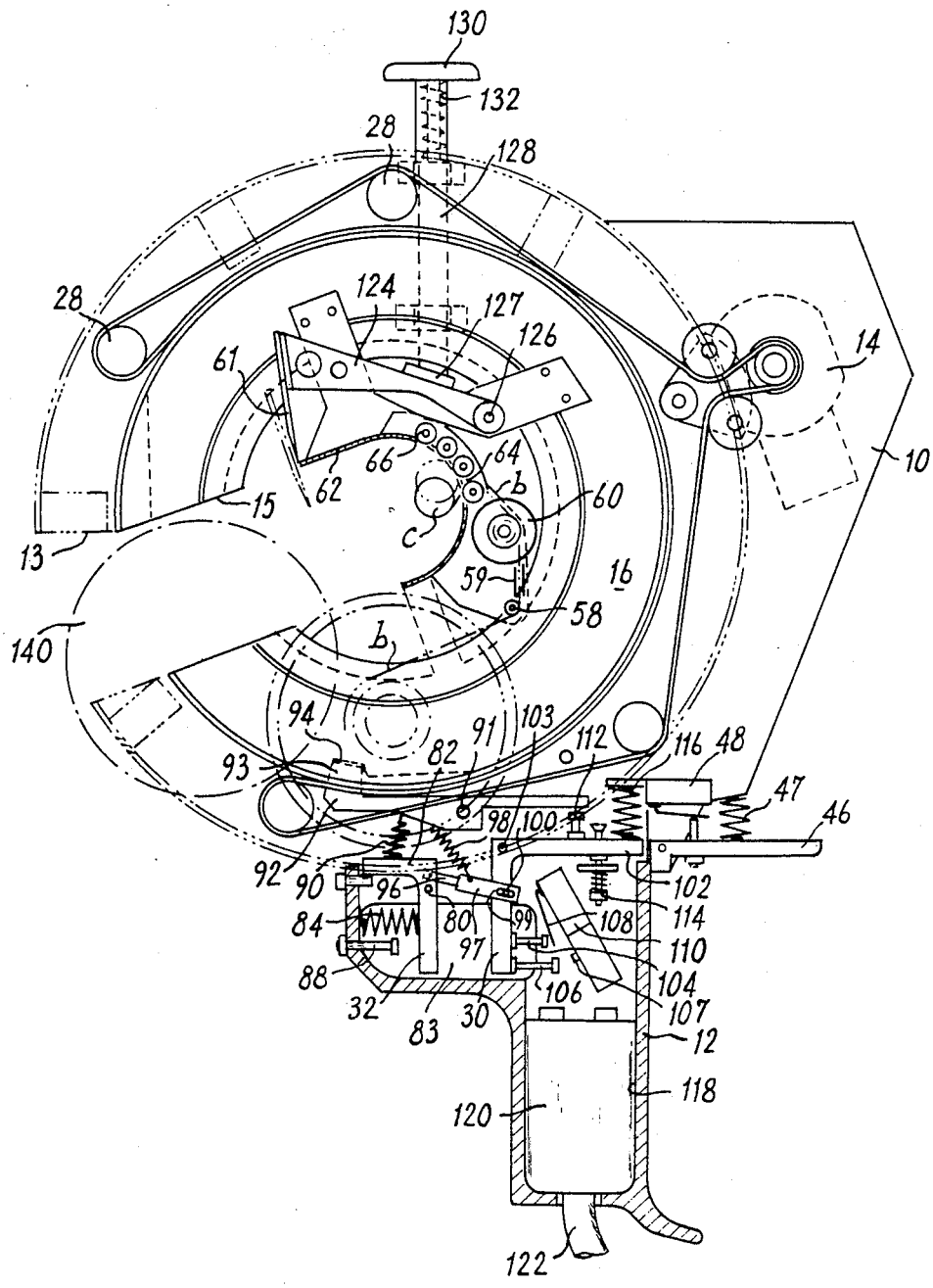
FIG. 4 illustrates another alternative embodiment as seen as a longitudinal section along line IV—IV of FIG. 6.
Figure 5:
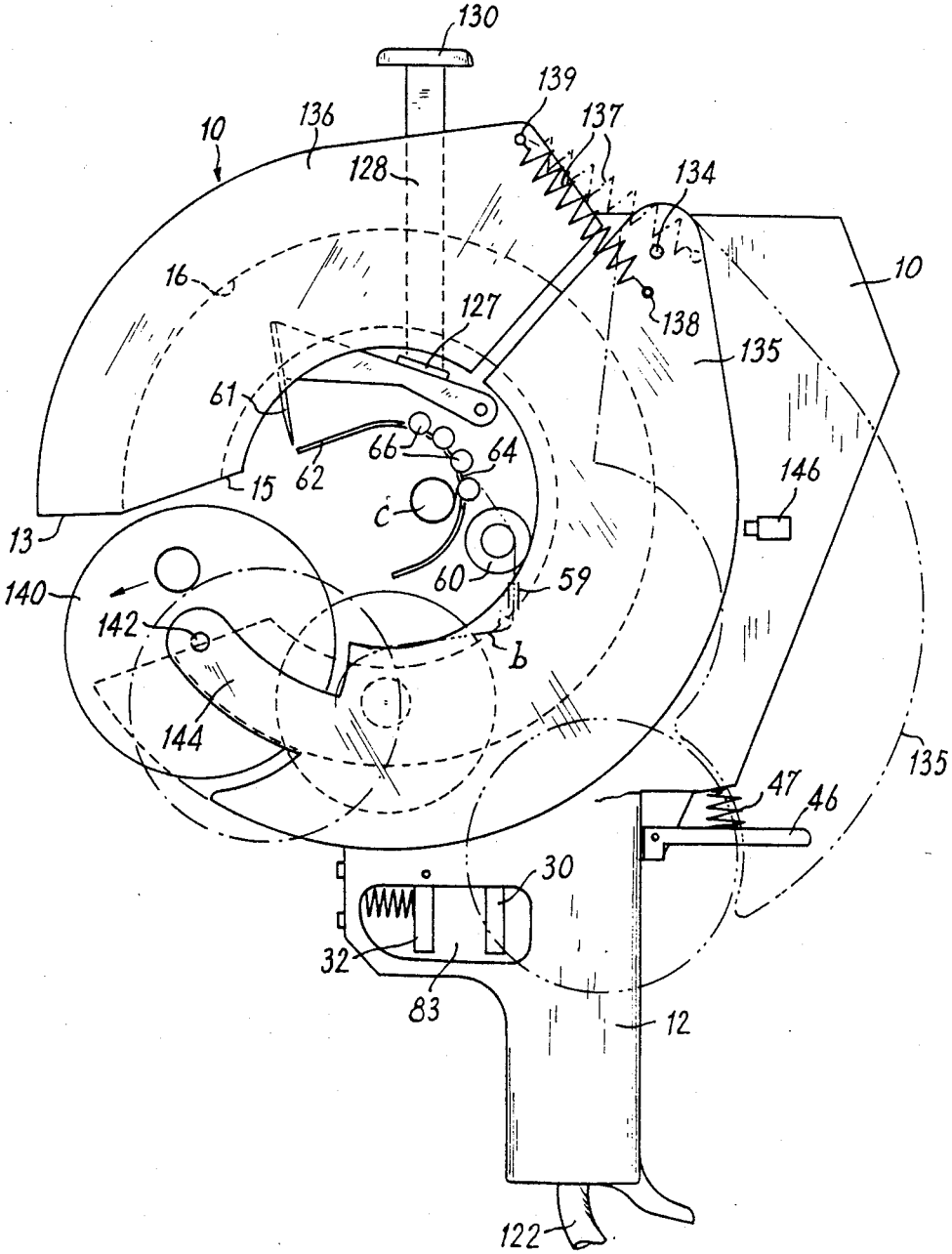
FIG. 5 is an elevational view of the same embodiment as in FIG. 4.
Figure 6:
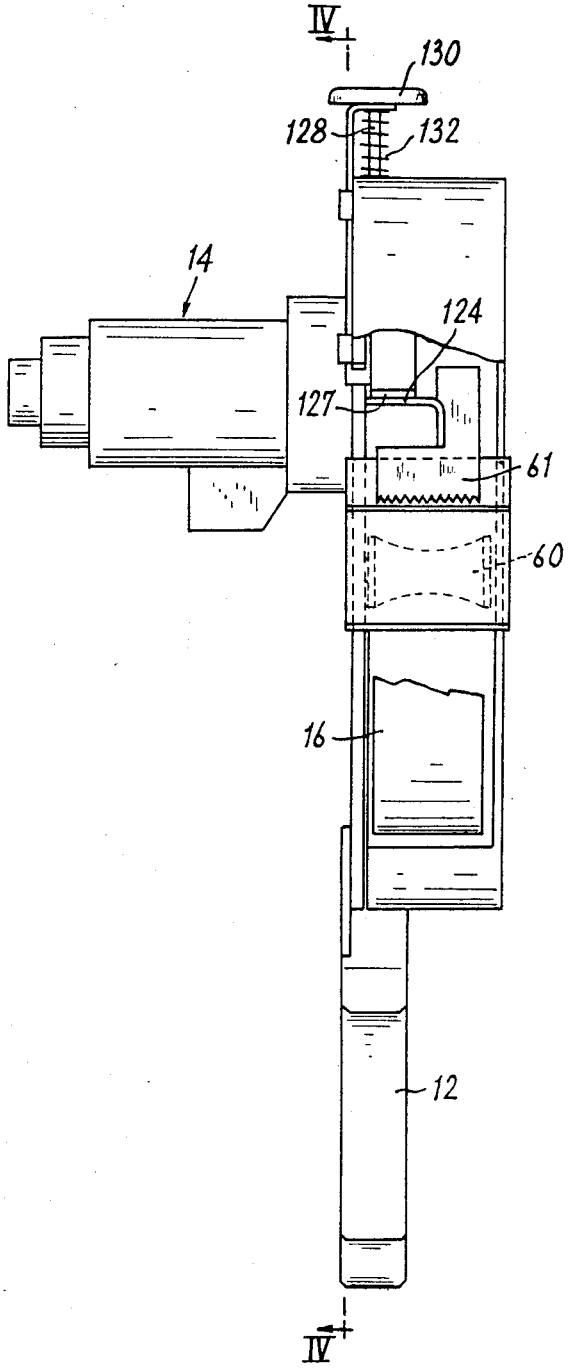
FIG. 6 is an end view of the device according to a variation of FIG. 4.

FIGS. 4 to 6 illustrate an alternative embodiment of the device in consideration in which are used identical reference numerals for designating the same members. Thus, one finds again platen 10, the gripping handle 12, the driving motor 14, the belt 18 with its guiding rollers 20, 26, 27, 28, the rotary crown 16 and the curved guide 62 associated therewith. Also appear in these figures passage 13 in the platen and opening 15 in crown 16, as well as article C to be taped with tape b paid out from coil B.

In this embodiment, the control of the device is again provided by means of a double trigger system 30–32. In this case however, the motor control mode is different, as well as the arrangement of the means allowing the initial repositioning of the crown with respect to the platen during the introduction of article C.

Trigger 32 is thus articulated about a pivoting axis 80 and includes an angled portion 82. A spring 84 is mounted between trigger 32 and the bottom facing handle 12, whereby the pivoting of the trigger against said spring can be carried out until it comes to bear on an abutment rod 88. The trigger is pushed back in the corresponding direction by the user's finger engaged inside space 83 formed between the two triggers 30 and 32. During this movement, the angled portion 82 compresses another spring 90 acting on a transverse rod or small bar 92, formed at its end with a prolongation forming a nose 93, adapted to engage inside a housing 94 provided in the rotary crown 16 for securing said crown against motion, notably when the opening 15 of said crown is in register with passage 13 of the platen. On trigger 32 is also articulated a rod 96 prolongating a push-piece 97, connected by a spring 98 to the platen. The transverse rod 92 is mounted mobile about an axis 91 so that its pivoting motion, this time against spring 90, allows disengaging nose 93 from housing 94 by freeing crown 16. The end-piece 97 includes an eyelet 99 in which moves a pin 100 carried by the second trigger 30. Said trigger includes just as the first one an angled portion 102 and is articulated on the platen about an axis 103. On the other hand, it is provided with two abutments, respectively 104 and 106, of different lengths as shown in FIG. 4, whereby said abutments allow acting according to the position of trigger 30 on the mobile contact 108 of the micro-relays 110 mounted inside handle 12. On angled portion 108 of trigger 30 is mounted an abutment 112, a resilient return mechanism 114 and finally a spring 116.

The operation of the double trigger system is in this second embodiment the following: by acting on trigger 32, the user exerts on a connected spring an effort which pushes back rod 92, and at the same time he controls the rotation of motor 14 at a slow speed until, when the position of crown 16 or of its opening 15 is in registry with passage 13, nose 93 falls inside housing 94 and secures the crown against motion.

At that moment, the user slacks off his effort on trigger 32 and, once article C has been put in position in the curved guide 62, he can start the normal rotation of the crown and the taping operation of the article with tape b in the manner already described with reference to the first embodiment. In this case however, the action of trigger 30 on the control of the motor is no more progressive but made for two distinct speeds, respectively slow and more rapid according to needs.

To this effect, trigger 30, by pivoting under the effect of the user's finger about its axis 103, exerts via abutment 112 a retraction effect of nose 93, by slightly rotating rod 92 about its axis 91. Simultaneously, trigger 30 presses the first abutment 104 onto contact 108 and closes via micro-relay 110 the power fed to motor 14 driven at a slow speed for example. If the user keeps on pressing trigger 30, it is the second abutment 106 which closes a second contact 107 on the micro-relay, motor 14 rotating then at a higher speed. It should be noted that the presence of the resilient return device 114 allows the user to feel by the touch a clear separation between the two operating modes and to cause the driving of the motor at a higher speed only after having cleared the resistance opposed to the trigger by said device 114. Abutment 112 assists the tipping motion of rod 92, spring 116 exerting a permanent return effort on trigger 30 as soon as the user releases it.

Advantageously and in the variant shown in said figures, the gripping handle 12 of the device is hollow and includes the electric connection members necessary for the control of motor 14. Reference numeral 122 shows schematically the connecting wire connecting in this case the apparatus to an outer voltage source, not shown. Alternately, one can mount inside the handle a battery 120 connected, when the apparatus is not used, to a standard loader, so as to provide an operating autonomy of the device without it being necessary in this case to connect it via a wire to an outer energy source, whereby this can be in some cases a particularly appreciated advantage.

In the example shown in FIGS. 4 to 6, the cutter 61 which severs the tape at the end of the taping operation is mounted in a different position to that shown in the example of FIGS. 1 to 3. Said cutter 61 is in this case articulated on a lever 124 pivoting about an axis 126, said axis including an anvil 127 on which can be exerted a downwardly directed effort obtained by a punch 128 which is in turn adapted to be actuated by a so-called "punch" control knob 130. Knob 130 is subjected to the action of a spring 132 returning it permanently in a position where cutter 61 is lifted up and outside the curved guide 62.

In this same variant, guide 62 includes an assembly of four rollers 66 advantageously mounted outside the guide in openings of said guide in such manner that they slightly protrude inwardly in order to facilitate the support and holding of article C during the taping operation. Of course, said dispositions are implemented together with those already foreseen in the first embodiment, with in particular the slot 64 through which passes tape b, eventually with the bulging shape of the brass guide, or other, and its possible coating with a plastic material. On the other hand, in this case as previously, tape b, when passing on concave shaped roller 60 can have its orientation changed as required, according to the wishes of the user who, according to the situation, the needs and the relative position of the device with respect to the article, can modify the winding direction and the angle of the helix formed.

In the example shown in FIGS. 4 to 6, the machine includes moreover a protection device for the user and a latching device for the passage 13 provided in the platen, once the article to be taped is in position, with a structure different to that of the previous embodiment.

In this case, platen 10 includes an axis 134 about which is articulated a cowling 135 arranged so as to move opposite a similar fixed cowling 136. The fixed cowling and the mobile cowling are connected to each other by a return spring 137 the extremities of which are respectively attached to two pins 138, 139 belonging each to one of the cowlings, said spring acting in the latched position where the cowlings are near each other to close the passage 13 of the platen and the opening 15 of the crown, notably due to a support roller 140 rotating about an axis 142 on a clevis 144 provided at the end of the mobile cowling 135. When said cowling 135 is opened, spring 137 is such that it moves to the other side of axis 134 while exerting on the cowling an effort which maintains the latter away. A micro-contact 146 acts in this opened position of the movable cowling 135 to cut the power fed to motor 14 which cannot operate or only when the cowling is brought back to its closed position.

In FIGS. 4 and 5 is finally illustrated a modification of the urgency stop knob made in this case of a knob 46 articulated on the handle, against a spring 47 and allowing, when tipped, to cut also the power fed to the motor via a complementary micro-contact 48.

What is claimed is:

1. A portable manual control device for taping articles such as for example bunches of electrical cables with a flexible material in the shape of a tape, a band or a cord, unwound from a coil carried by the device, said device including a platen supporting a driving motor as well as control means for said motor, and formed with an opened passage for receiving the article, a rotary crown rotating on the platen being controlled in rotation by the motor via a driving means, the crown being formed with an opening in which is engaged the article to be taped when said opening is in register with the opened passage of the platen, and at least one feed coil with the flexible material in the shape of a tape, band or cord, with return and guiding means for said material, characterized in that the rotary crown includes in the bottom of its opening receiving the article a curved guide for positioning the article in the crown, a slot being provided in the guide for bringing the flexible material in contact with the article, said guide including moreover adjacent the slot at least two rollers for avoiding friction of the material while allowing its helical winding on the article, following the rotation of the crown and the manual displacement of the platen according to the length of said article, while controlling the pitch and the winding direction on said article, the platen being provided with a single handle held by the hand of a user while the article is guided by other hand of said user.

2. A device according to claim 1, wherein there are provided protection means carried by the platen at the inlet of the passage receiving the article to be taped, said protection means being provided preferably in the form of flaps, latched in a closed position when the rotary crown driving motor is operated, and of a circular shaped protective cowling, preferably transparent.

3. A device according to claim 2, wherein said flaps are latched via a stem operated by the control of triggers causing the rotation of motor, or by the closing of an electric contact.

4. A device according to claim 1, wherein the gripping handle provided on the platen includes a double control trigger system for the motor, a first trigger for the control of the rotation of said motor for the taping operation and a second trigger for a progressive control of the rotation, for starting a positive repositioning cycle of the rotary crown in order to bring the apparatus in the opened position, that is in a position which brings in register the passage of the platen and the opening of the rotary crown so as to facilitate the introduction and extraction respectively of the articles to be taped and of the articles which have been taped.

5. A device according to claim 4, wherein said first trigger, actuates the control motor via a second trigger with the assistance of a roller coming to bear on a push-piece carried by trigger or by an appropriate lever, whereby the two triggers can be latched, notably with the assistance of a pin-slot type system.

6. A device according to claim 5, wherein the motor is an electric motor the control of which is effected by varying the field created in a coil via the double trigger system.

7. A device according to claim 1 wherein the system providing for the driving of the mobile crown with the assistance of the motor is made of an endless belt provided with a tensioning system of the double rocking lever type, having an action proportional to the resisting torque in order to obtain a tensioning of the belt reduced to the minimum.

8. A device according to claim 1 characterized in that said device is provided with a simplified and light weight advance system, rotatably connected to the mobile crown, for example via an automotive friction roller assembly coming to bear against the article to be taped.

9. A device according to claim 1, wherein the curve-shaped guide has a branch longer than the other so as to urge by the top the article to be taped toward the bottom and in the middle of the guide.

10. A device according to claim 1, characterized in that the flexible material unwound from the feed coil is guided prior to its entry in the slot of the curved guide by at least one roller and concave-shaped member authorizing changes of the winding direction of the material on the article to be taped.

11. A device according to claim 1, wherein the curved guide has a bulging section and is made of a low friction coefficient material, notably brass, and is eventually coated with an appropriate plastic layer.

12. A device according to claim 1, characterized in that said device is made so as to form a unidirectional winding of the flexible material, while allowing by a rotation of 180°, with the assistance of a rotation ring, carrying out a winding according to two directions of operation with the same helix, the device comprising then two symmetrical operating handles.

13. A device according to claim 1, wherein there is provided an emergency stop knob mounted on the platen and actuated by the top of the user's wrist for obtaining an immediate stoppage of the driving motor.

14. A device according to claim 1, wherein the handle includes two triggers, of which one acts via abutments of different lengths on the contacts of a micro-relay causing according to the case the operation of the motor at constant but different speeds.

15. A device according to claim 14, wherein a pivoting rod formed with a nose is provided for engagement inside a housing of the rotary crown for positioning said crown in such manner that the platen passage be in register with the crown opening for introducing the article to be taped in the curved guide.

16. A device according to claim 1, wherein the platen handle is hollow and includes a rechargeable battery for the autonomous control of the driving motor.

17. A device according to claim 1, wherein the platen supports a fixed half cowling and a mobile half cowling, both articulated on the platen, the two half cowlings being returned to a bearing position one against the other in order to close the passage of the platen under the effect of a spring attached at its ends on one and the other of said half cowlings.

18. A device according to claim 17, wherein the mobile half cowling comprises at the end of the passage formed in the platen a roller rotatably mounted at the end of a clevis rigid with the half cowling.

19. A device according to claim 1, wherein the flexible material, prior to traversing the slot formed in the curved guide passes through a brake for adjusting its tension.

20. A device according to claim 1, wherein the rollers placed in the vicinity of slot are supported by the curved guide outside of said guide and extend through openings formed in said guide in order to slightly protrude inside so as to support and guide the article to be taped.

* * * * *